US007550674B2

(12) United States Patent
Jean

(10) Patent No.: US 7,550,674 B2
(45) Date of Patent: Jun. 23, 2009

(54) UTP CABLE

(75) Inventor: Frédéric Jean, Lititz, PA (US)

(73) Assignee: Nexans, Paris (FR)

( * ) Notice: Subject to any disclaimer, the term of this patent is extended or adjusted under 35 U.S.C. 154(b) by 101 days.

(21) Appl. No.: 11/709,913

(22) Filed: Feb. 22, 2007

(65) Prior Publication Data

US 2007/0235208 A1 Oct. 11, 2007

(51) Int. Cl.
*H01B 7/00* (2006.01)

(52) U.S. Cl. ..... 174/110 R; 174/113 R; 174/113 C

(58) Field of Classification Search ..... 174/110 R, 174/113 R, 113 C, 115, 116, 113 AS, 120 R, 174/120 SR, 120 SP
See application file for complete search history.

(56) References Cited

U.S. PATENT DOCUMENTS

| | | | | |
|---|---|---|---|---|
| 3,843,829 | A * | 10/1974 | Bridges et al. | 174/36 |
| 6,153,826 | A * | 11/2000 | Kenny et al. | 174/27 |
| 6,259,031 | B1 * | 7/2001 | Totland et al. | 174/110 R |
| 6,462,268 | B1 * | 10/2002 | Hazy et al. | 174/36 |
| 6,800,811 | B1 | 10/2004 | Bouicno | 174/113 |
| 6,875,928 | B1 * | 4/2005 | Hayes et al. | 174/113 R |
| 7,049,519 | B2 * | 5/2006 | Wiekhorst et al. | 174/80 |
| 7,145,080 | B1 * | 12/2006 | Boisvert et al. | 174/110 R |
| 7,173,189 | B1 * | 2/2007 | Hazy et al. | 174/110 R |
| 7,375,284 | B2 * | 5/2008 | Stutzman et al. | 174/110 R |
| 2003/0106704 | A1 * | 6/2003 | Isley et al. | 174/113 R |
| 2003/0132021 | A1 | 7/2003 | Gareis | 174/113 |
| 2004/0149483 | A1 * | 8/2004 | Glew | 174/113 C |
| 2004/0149484 | A1 * | 8/2004 | Clark | 174/113 R |
| 2005/0092514 | A1 | 5/2005 | Kenny et al. | 174/113 |
| 2005/0092515 | A1 | 5/2005 | Kenny et al. | 174/113 |
| 2005/0279528 | A1 | 12/2005 | Kenny et al. | 174/113 |
| 2006/0021772 | A1 | 2/2006 | Dellagala et al. | 174/27 |
| 2006/0237217 | A1 | 10/2006 | Glew | 174/113 |
| 2006/0237219 | A1 | 10/2006 | Glew | 174/113 |
| 2006/0243477 | A1 | 11/2006 | Jean et al. | 174/113 |

FOREIGN PATENT DOCUMENTS

| | | |
|---|---|---|
| EP | 0942440 | 9/1999 |
| KR | 20060009448 | 2/2006 |
| WO | WO2006050612 | 11/2005 |
| WO | WO2006065414 | 11/2005 |

* cited by examiner

*Primary Examiner*—William H Mayo, III
(74) *Attorney, Agent, or Firm*—Sofer & Haroun, LLP

(57) ABSTRACT

A cable having a plurality of unshielded twisted pairs, each of which has a different lay length. A jacket encloses the plurality of unshielded twisted pairs, where the unshielded twisted pair with the longest lay length among the plurality of unshielded twisted pairs is positioned within the center of the jacket, substantially along the central longitudinal axis of the cable.

12 Claims, 4 Drawing Sheets

UTP CABLE

FIELD OF THE INVENTION

The present invention relates to copper wire cables. More particularly, the present invention relates to improved UTP (Unshielded Twisted Pair) cables.

BACKGROUND OF THE INVENTION

In the field of copper wire communication cables, the copper wires are arranged in pairs. Although a single pair may stand alone, it is common for copper wire pairs to be bundled into multiple pairs within a single outer jacket. Although any number of pairs may be contained within a single jacket, a particularly common arrangement is to include four pairs within a jacket.

A common problem in unshielded copper wire cables (containing only twisted pairs of insulated copper wire without any metal shielding) is crosstalk which generally refers to communication signal interference that occurs between signals traveling along two different adjacent or near by copper wire pairs. To address this, the copper wire pairs are twisted around one another at a particular rate, forming a twisted pair, so as reduce crosstalk between the pairs. The twisting of the copper wire pairs reduces the instances that a first pair of wires runs in parallel to a second pair of wires, thus reducing crosstalk between the pairs. The rate of twisting in the pairs results in a particular lay length referring to the longitudinal length along which one full twist of the copper wires occurs.

In prior art arrangements where four twisted pairs are included in one jacket it is common to use four different lay lengths, one for each of the four twisted pairs. These varied rates of twisting results in a reduced number of incidences where the wires in the pairs run parallel to one another, affecting a reduction in crosstalk. For example, in a typical four pair cable, arranged in a compact square/rectangle, there are six different crosstalk combinations that need to be addressed, as shown in prior art FIG. 1 (labeled C1-C6).

It is typically known that the shorter the lay length of a particular pair in a multi-pair cable, the more crosstalk is reduced. However, shorter lay lengths obviously use more wire per length of cable, and thus there are limitations on how short the lay length can be in any given copper wire twisted pair. Therefore, it is ideal to have the longest lay length possible that meets the desired crosstalk threshold.

In addition to the crosstalk that occurs between pairs within the same cable, an additional type of interference occurs between twisted pairs in adjacent cables referred to as ALIEN crosstalk. Although crosstalk within a jacket is easier to manage because the lay lengths of the closest pairs can be tightly managed, ALIEN crosstalk is harder to predict and mitigate, since external cable conditions (the number of adjacent cables, having the exact same twist rate from cable to cable, the distance between adjacent cables, longer pair lay length in adjacent cables, unknown lay lengths of twisted pairs in adjacent cables, etc. . . . ) can not be easily predicted.

One prior art method for preventing such ALIEN crosstalk is to provide shielding for the cable jacket. However, this shielding is not always feasible as it adds significant costs, installation time and weight to the cable. Another manner for providing protection against ALIEN crosstalk is to provide a gap between the pairs and the inside diameter of the jacket by placing a helical filament around the pairs within the cable. The gap produces a greater physical distance between the pairs of a first cable and the pairs of an adjacent cable, but the filament adds complexity to the production process and furthermore results in significantly larger cable diameter (0.350" when applied to a typical four twisted pair cable).

Thus, the problem of ALIEN crosstalk between twisted pairs in adjacent cables still persists, yet the prior art solutions have proven to be inadequate for smaller cable diameters.

OBJECTS AND SUMMARY

The present invention overcomes the drawbacks associated with the prior art and provides a cable design for reducing ALIEN crosstalk between pairs of adjacent cables, without the need for complex, heavy or expensive shielding or helical filaments, and also simultaneously reduces the total outer diameter of the cable and the incidences of crosstalk between pairs within the cable itself.

To this end the present invention is directed to a cable for reducing crosstalk. The cable includes a plurality of unshielded twisted pairs, each of which has a different lay length. A jacket encloses the plurality of unshielded twisted pairs, where an unshielded twisted pair that has the longest lay length among the plurality of unshielded twisted pairs is positioned within the center of the jacket, substantially along the central longitudinal axis of the cable.

BRIEF DESCRIPTION OF THE DRAWINGS

The present invention can be best understood through the following description and accompanying drawings, wherein.

DETAILED DESCRIPTION

Figure 2:
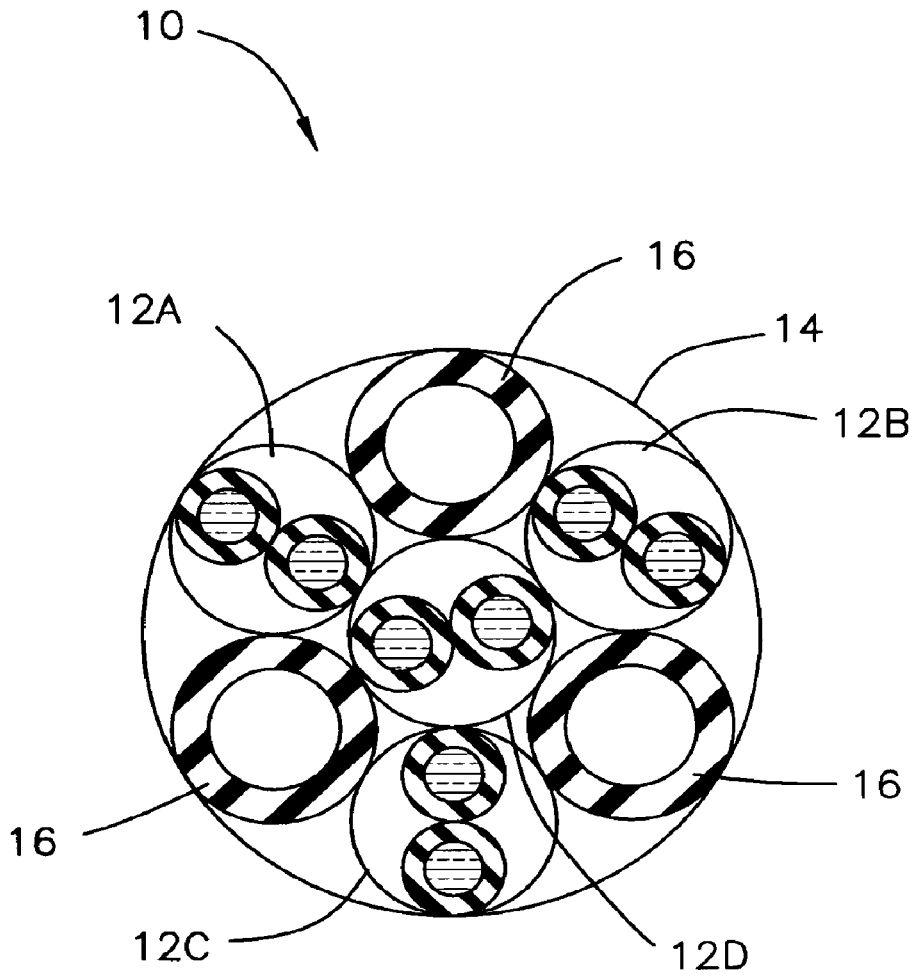
FIG. 2 is a cross section of a four twisted pair cable according to one embodiment of the present invention.

In one embodiment of the present invention, as illustrated in FIG. 2, a cable 10 is provided having four twisted pairs 12*a*-12*d* of unshielded copper wire within an outer extruded jacket 14.

For the purposes of illustrating the salient features of the present invention cable 10 is shown to have four twisted pairs 12. However, the invention is not limited in this respect. The present invention may also be applied to cables having larger or smaller counts of twisted pairs 12 as desired.

Twisted pairs 12*a*-12*d* are described as copper, but any desired conductive metal may be substituted as desired. Furthermore, the copper in pairs 12 are coated with typical polymer coatings, such as PE (Polyethylene) or FEP (Fluoronated Ethylene Polymer) or other insulators based on the desired cost and fire safety standards. Jacket 14 is also an extruded polymer as well, formed from PVC (Poly Vinyl Chloride) or FRPVC (Flame Resistant PVC), or other such polymer compositions.

As with standard four pair cables each of twisted pairs 12*a*-12*d* have a different rate of rotational twisting resulting in different lay lengths. In the present illustration, twisted pair 12*a* is presumed to have the shortest lay length and pair 12*d* has the longest lay length. For example a typical cable 10 may employ lay lengths in the ranges of 0.3" to 0.55" (0.3", 0.325", 0.35" and 0.55"). Obviously, these lay lengths for pairs 12 are by way of illustration only, with the invention being equally applicable to any desired lay lengths depending on the desired crosstalk tolerance and desired mechanical (weight etc. . . . ) specifications.

As shown in FIG. 2, pairs 12*a*-12*d* are arranged in a three spoked wheel arrangement with pair 12*d*, having the longest lay length, being centrally located substantially along the center longitudinal axis of cable 10. The three pairs 12*a*-12*c* having the shorter lay lengths are disposed apart from one another, outwards towards the inside diameter of jacket 14. Ideally, pairs 12*a*-12*c* are disposed substantially 120° apart.

In one embodiment of the present invention, bumper elements 16, are disposed around central pair 12*d* and in between pairs 12*a*, 12*b* and 12*c* respectively. Bumper elements 16 are typically polymers formed as solid, foamed or hollow structures, however, alternative materials and structures may be used. Bumpers 16 are advantageously of a dimension substantially equal to the diameter of a twisted pair 12, and are used for maintaining a regular geometry along the length of cable 10 as shown in FIG. 2. Additional functions may be added to bumpers 16 if necessary, such as tensile strength, crush resistance etc. . . . , by modifying the shape, size and/or composition of bumpers 16.

It is noted that FIG. 2 shows a cross section of twisted pairs 12 and bumper elements 16 within jacket 14. However, it is understood that these elements are stranded within jacket 14 in a typical manner such that they exhibit either a helical or SZ (periodically reversing helical) geometry to address mechanical issues such as cable spooling and unwinding/installation. Additionally, a binder ribbon may be optionally applied over pairs 12 around the core under jacket 14, for example by extrusion, on top so that pairs 12 maintain their correct geometry.

This configuration provides a distinct advantage over prior art arrangements in addressing issues arising from ALIEN crosstalk. As noted above in the background, twisted pair 12*d*, having the longest lay length, encounters the greatest amount of problems with ALIEN crosstalk. The arrangement of the present invention, by locating twisted pair 12*d*, having the longest lay length, in the center of cable 10, provides for an increased distance from the twisted pairs in adjacent cables without the need for additional gaps or shielding.

Figure 1:
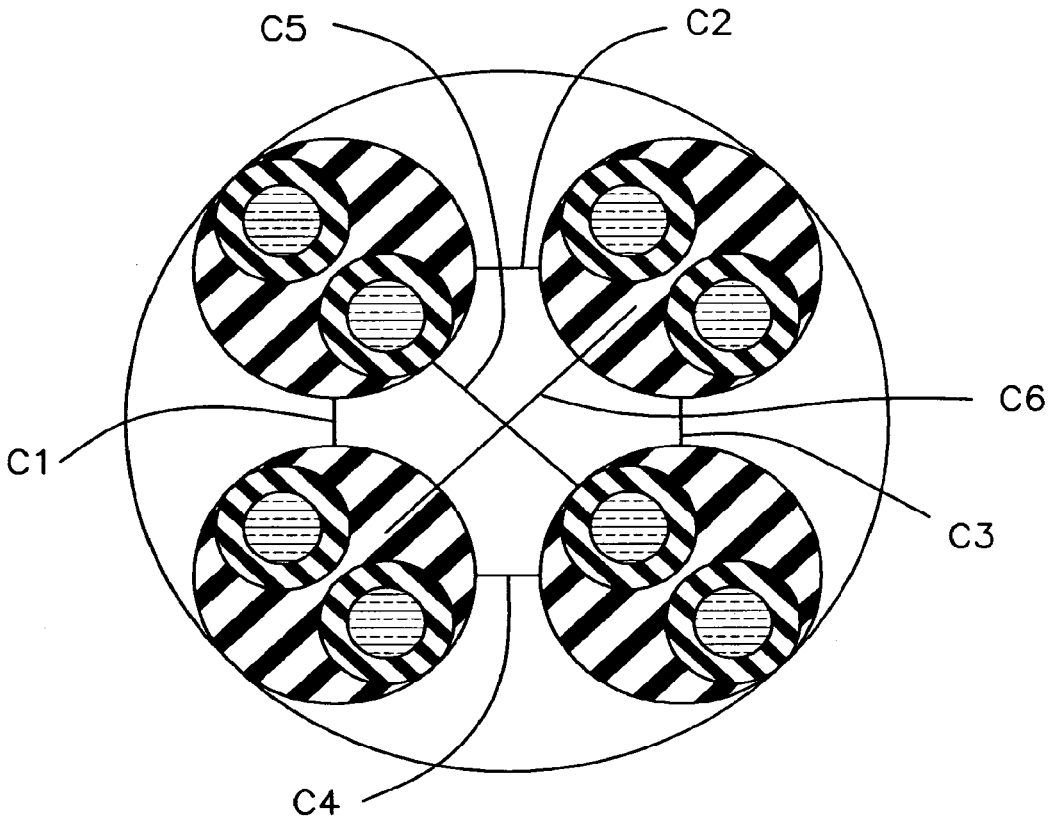
FIG. 1 (PRIOR ART)
FIG. 1 is a prior art figure of a four twisted pair cable showing the six cross-talk combinations.

In addition to this advantage achieved to reduce ALIEN crosstalk, the same arrangement also provides an advantage over prior art in managing the cross-talk within cable 10 itself. As noted in the background and as shown in prior art FIG. 1, a typical four twisted pair cable has six different crosstalk combinations (C1-C6) that need to be addressed because all four pairs are either near or in direct contact with one another. However, in the present invention, because of the central location of twisted pair 12*d* and the 120° separation between the other pairs 12, twisted pairs 12*a*-12*c* exhibit a separation from one another, reducing the crosstalk combinations to three, namely 12*a*-12*d*, 12*b*-12*d* and 12*c*-12*d*. This allows for the manufacture of more lay length options for the shorter three lay length pairs 12*a*-12*c*, possibly allowing for lighter and less expensive longer (though not longer than 12*d*) lay lengths.

According to the arrangement of the present invention an improvement in internal crosstalk is found over prior art. For example, in a prior art four pair cable, with corresponding lay lengths, (P1 0.3", P2 0.45", P3 0.35", P4 0.4") there is crosstalk measured at 52.5−18 Log(f/100) dB between 1-2, 2-3 and 2-4 and 49.5−18 Log(f/100) dB between 1-3, 1-4 and 3-4, where f=frequency.

On the other hand, the arrangement of the present invention from FIG. 2 where P1 (12*a*) 0.3", P3 (12*b*) 0.325", P4 (12*c*) 0.35" and P2 (12*d*) 0.55", a crosstalk of 63.5−18 Log(f/100) dB is achieved between pairs 1-2, 2-3 and 2-4 for an improvement of 21% and a crosstalk of 58.5−18 Log(f/100) dB is achieved between pairs 1-3, 1-4 and 3-4 for an improvement for 18%. Additionally, it is noted that such reduction in internal crosstalk is achieved with closer twist rates/lay lengths and with a positioning of the longest lay length P2 in the center thus simultaneously reducing ALIEN cross talk.

Figure 3:
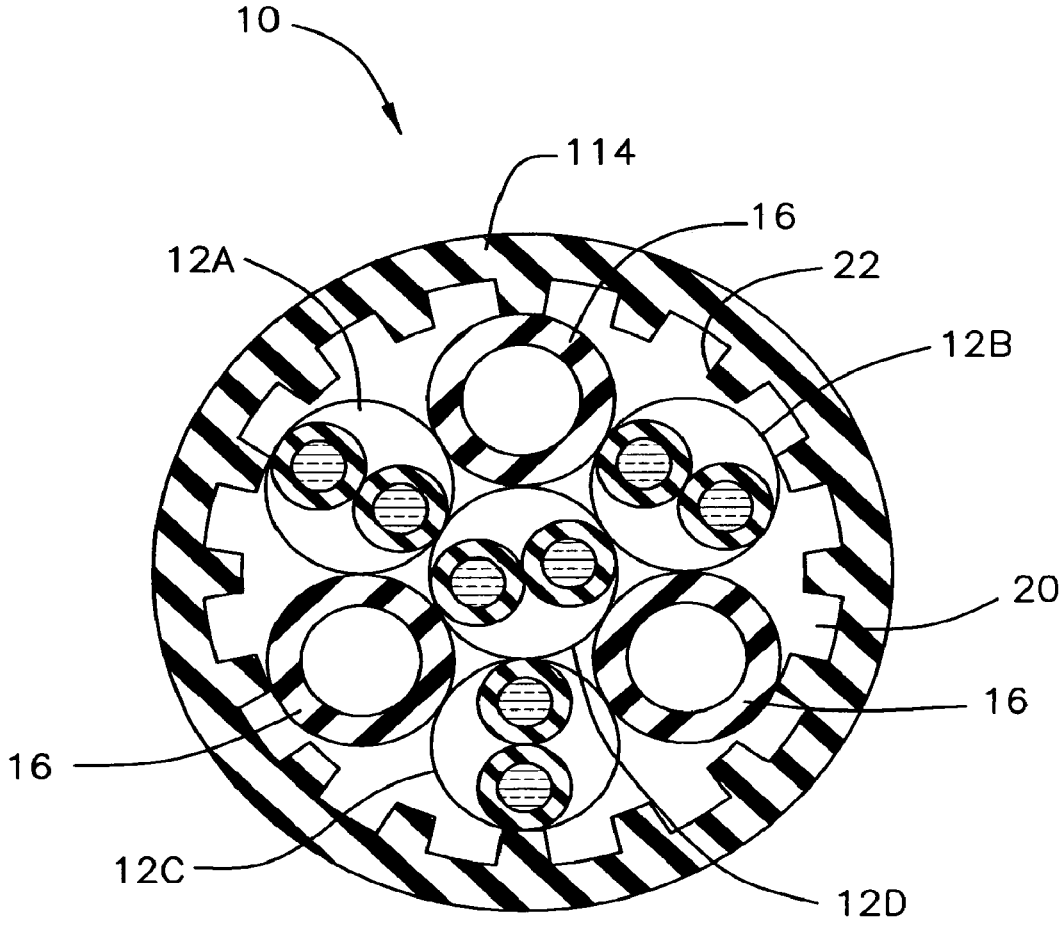
FIG. 3 is a cross section of a four twisted pair cable according to another embodiment of the present invention.

In another embodiment of the present invention, as illustrated in FIG. 3, jacket 114 may be formed in a different manner, having alternating grooves 20 and ridges 22 disposed about the inner circumference of jacket 114. These ridges 22 are configured to further distance pairs 12*a*-12*d* from the outer circumference of jacket 114, further reducing the incidences of ALIEN crosstalk with pairs located in adjacent cables. Furthermore, such a configuration reduces the contact surface between pairs 12*a*-12*c* and the inside diameter of jacket 114, providing the further benefit of reducing any insertion loss in the signals within pairs 12 caused by the polymer jacket 114. Such an arrangement, even with the added grooves 20 and ridges 22, maintains a smaller total outer diameter for cable 10 than the prior art of substantially (0.29"-0.32"). According to such an arrangement, the insertion loss may be significantly reduced by 2-3% over a similarly arranged non-ridged cable with a reduction in propagation delay of 4 to 6 nanoseconds per 100 m, amounting to a substantially 1% reduction.

Figure 4:
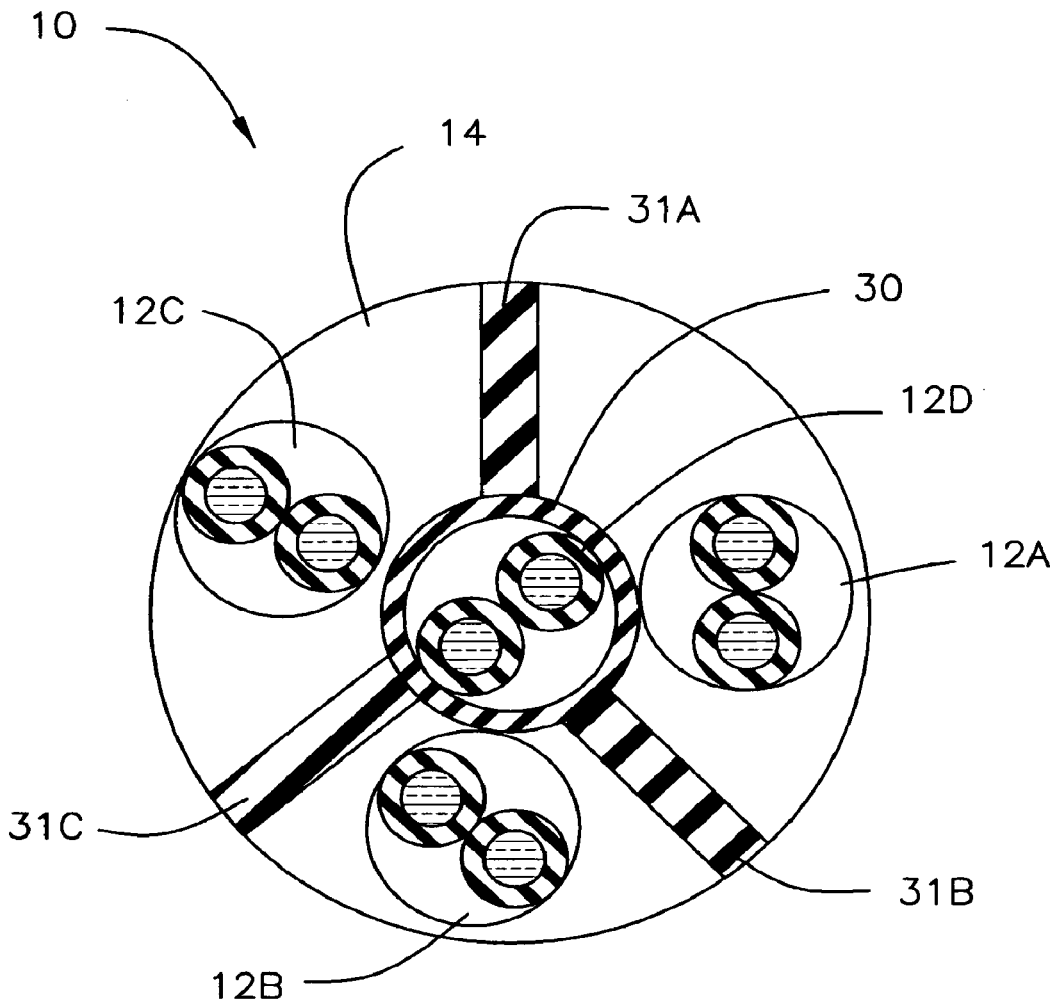
FIG. 4 is a cross section of a four twisted pair cable according to another embodiment of the present invention.

In one embodiment of the present invention as illustrated in FIG. 4, an alternative arrangement cable 10 is formed with a jacket 14 and four twisted pairs 12*a*-12*d*. However, instead of using three bumper elements 16 to maintain the separation between pairs 12*a*-12*c* it is contemplated that pair 12*d* in the center of cable 10 be encased within an additional polymer jacket 30 having three separators 31*a*-31*c*. The polymer jacket 30 places an additional barrier between each of pairs 12*a*-12*c* and pair 12*d*, while separators 31*a*-31*c* maintain the separation between pairs 12*a*-12*c*, both of which assist in reducing internal crosstalk between pairs 12 as well as allowing cable 10 to centrally locate the longest lay length pair 12*d*.

Advantageously, polymer jacket 30 is formed with branches 31*a*-31*c* as a single unit, or alternatively, branches 31*a*-31 may be formed separately and later attached or folded into jacket 30. Although branches 31*a*-31*c* are shown as straight branches, it is contemplated that they be of any useful shape and design (solid/hollow, rectangular/oval/trapezoidal) as desired for maintaining a desired weight and geometry for cable 10.

In another embodiment of the present invention jacket 30 is optionally, formed as a metal or metallized sheath material for improved cross talk reduction. Likewise, separators 31*a*-31*c* are made of metal or are metallized for improved cross talk reduction among the peripheral pairs 12*a*-12*c*. Furthermore, foil wrapping may be used around pairs 12*a*-12*d* to even further improve the cross-talk reduction within cable 10.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

The invention claimed is:

1. A cable for reducing crosstalk, said cable comprising:

a plurality of unshielded twisted pairs, each of which is an insulated conductor pair twisted around one another, each having a different lay length; and a jacket enclosing said plurality of unshielded twisted pairs, wherein an unshielded twisted pair, having the longest lay length among said plurality of unshielded twisted pairs, is positioned within the center of said jacket such that an axis of said twisted pair having the longest lay length substantially coincides with the central longitudinal axis of said cable.

2. The cable as claimed in claim 1, wherein said unshielded twisted pairs are twisted pairs of copper wire.

3. The cable as claimed in claim 2, wherein said twisted pairs are wrapped in foil.

4. The cable as claimed in claim 1, wherein said cable maintains four unshielded twisted pairs, each of different lay lengths, the longest lay length of said four twisted pairs, being said centrally located unshielded twisted pair.

5. The cable as claimed in claim 4, wherein the three non-longest lay length unshielded twisted pairs are located away from the center of said cable along an inside diameter of said jacket, disposed substantially 120 degrees apart from one another.

6. The cable as claimed in 5, wherein said cable further comprises three bumper elements disposed between said non-longest lay length unshielded twisted pairs.

7. The cable as claimed in claim 5, wherein said unshielded twisted pair having the longest lay length and being centrally located maintains an additional jacket.

8. The cable as claimed in claim 7, wherein said unshielded twisted pair having the longest lay length and being centrally located is shielded.

9. The cable as claimed in 7, wherein said additional jacket around said unshielded twisted pair having the longest lay length and being centrally located further comprises three radially extending branches.

10. The cable as claimed in claim 9, wherein each of said radially extending branch is disposed between two of said three non-longest lay length unshielded twisted pairs.

11. The cable as claimed in claim 10, wherein said jacket has alternating grooves and ridges.

12. The cable as claimed in claim 1, wherein said jacket has alternating grooves and ridges.

* * * * *